US011333406B2

(12) United States Patent
Hoehne

(10) Patent No.: US 11,333,406 B2
(45) Date of Patent: May 17, 2022

(54) REGENERATOR FOR A CRYO-COOLER THAT USES HELIUM AS A WORKING GAS

(71) Applicant: Pressure Wave Systems GmbH, Taufkirchen (DE)

(72) Inventor: Jens Hoehne, Munich (DE)

(73) Assignee: Pressure Wave Systems GmbH, Taufkirchen (DE)

( * ) Notice: Subject to any disclaimer, the term of this patent is extended or adjusted under 35 U.S.C. 154(b) by 214 days.

(21) Appl. No.: 16/435,477

(22) Filed: Jun. 8, 2019

(65) Prior Publication Data

US 2019/0323737 A1 Oct. 24, 2019

Related U.S. Application Data

(63) Continuation-in-part of application No. PCT/EP2017/081750, filed on Dec. 6, 2017.

(30) Foreign Application Priority Data

Dec. 8, 2016 (DE) ..... 202016106860.6
Mar. 3, 2017 (DE) ..... 102017203506.4

(51) Int. Cl.
*F25B 9/14* (2006.01)

(52) U.S. Cl.
CPC ..... *F25B 9/145* (2013.01); *F25B 2309/002* (2013.01); *F25B 2309/1415* (2013.01)

(58) Field of Classification Search
CPC ..... F25B 2309/1415; F25B 2309/003
See application file for complete search history.

(56) References Cited

U.S. PATENT DOCUMENTS 4,359,872 A 11/1982 Goldowsky ..... F25B 9/02 62/6
6,131,644 A 10/2000 Kohara et al. ..... F28D 17/00 165/10

(Continued)

FOREIGN PATENT DOCUMENTS

CN 104197591 A 12/2014
DE 4401246 A1 7/1995

(Continued)

OTHER PUBLICATIONS

Office action of the German Patent Office in the related German patent application DE102017203506.4 dated Nov. 7, 2017 (6 pages).

(Continued)

*Primary Examiner* — Lionel Nouketcha
(74) *Attorney, Agent, or Firm* — Imperium Patent Works; Darien K. Wallace

(57) ABSTRACT

A regenerator of a cryo-cooler uses helium both as a working gas and as a heat storage material. The regenerator includes cells whose exterior sides form flow channels through which the working gas flows. Each cell has connected first and second cavities enclosed by a heat-conductive cell wall. The cavities contain helium that is used to store heat. Each cells is shaped as a disk. The working gas flows both through the flow channels and around the regenerator so as to exchange heat with the helium in the cavities via the heat conducting cell wall. Each cell has a pressure-equalizing opening through the cell wall whose diameter is smaller than the thickness of the cell wall. The diameter of the pressure-equalizing opening is dimensioned to permit the pressure of the helium contained in the cell to change by a maximum of 20% during any working cycle of the cryo-cooler.

20 Claims, 10 Drawing Sheets

(56) References Cited

U.S. PATENT DOCUMENTS

| | | | | |
|---|---|---|---|---|
| 2012/0304668 | A1 | 12/2012 | Xu | F25B 9/00 62/6 |
| 2013/0239564 | A1 | 9/2013 | Steiner et al. | F02G 1/057 60/526 |

FOREIGN PATENT DOCUMENTS

| | | | | | |
|---|---|---|---|---|---|
| DE | 19924184 | A1 | | 11/2000 | |
| DE | 10319510 | A1 | | 11/2004 | |
| DE | 102005007627 | A1 | | 9/2005 | |
| JP | 62-233688 | | | 3/1986 | |
| JP | 62-233688 | | | 10/1987 | |
| JP | 62233688 | A | | 10/1987 | |
| JP | 1-287207 | | | 5/1988 | |
| JP | 1-287207 | | | 11/1989 | |
| JP | H05-288416 | A | | 11/1993 | |
| JP | 7-318181 | | | 5/1994 | |
| JP | 7-151478 | | | 8/1994 | |
| JP | 7-151478 | | | 6/1995 | |
| JP | 7-318181 | | | 12/1995 | |
| JP | 07318181 | A | * | 12/1995 | F25B 9/14 |
| JP | H07-318181 | A | | 12/1995 | |
| JP | 2011-190953 | A | | 3/2010 | |
| JP | 2011-190953 | A | | 9/2011 | |
| JP | 2012-237478 | A | | 12/2012 | |
| JP | 2016-194307 | A | | 3/2015 | |
| JP | 2016-194307 | A | | 11/2016 | |

OTHER PUBLICATIONS

English translation of Office action of German Patent Office dated Nov. 7, 2017. (6 pages).

Office action of the Japanese Patent Office in the related Japanese patent application JP2019-507954 dated Jun. 3, 2021, as well as the English translation of the Japanese Office action (16 pages).

Office action of the Japanese Patent Office in a related Japanese patent application JP2019-526323 dated Nov. 22, 2021 citing references A-F, as well as the English translation of the Japanese Office action (10 pages).

* cited by examiner

REGENERATOR FOR A CRYO-COOLER THAT USES HELIUM AS A WORKING GAS

CROSS REFERENCE TO RELATED APPLICATION

This application is filed under 35 U.S.C. § 111(a) and is based on and hereby claims priority under 35 U.S.C. § 120 and § 365(c) from International Application No. PCT/EP2017/081750, filed on Dec. 6, 2017, and published as WO 2018/104410 A1 on Jun. 14, 2018, which in turn claims priority from German Application No. 202016106860.6, filed in Germany on Dec. 8, 2016 and German Application No. 102017203506.4, filed in Germany on Mar. 3, 2017. This application is a continuation-in-part of International Application No. PCT/EP2017/081750, which is a continuation-in-part of German Application Nos. 202016106860.6 and 102017203506.4. International Application No. PCT/EP2017/081750 is pending as of the filing date of this application, and the United States is an elected state in International Application No. PCT/EP2017/081750. This application claims the benefit under 35 U.S.C. § 119 from German Application Nos. 202016106860.6 and 102017203506.4. The disclosure of each of the foregoing documents is incorporated herein by reference.

TECHNICAL FIELD

The invention relates to a regenerator for cryo-coolers with helium as a working gas and a method for producing such a regenerator.

BACKGROUND

Periodically operated cryo-coolers, such as e.g., Stirling coolers, Gifford-McMahon coolers and pulse tube coolers, are operated in a regenerative manner, i.e., the heat capacity of a material is used for storing the cold and/or for precooling hot gas upon entering an expansion chamber. A problem arises at temperatures in the range from two degrees Kelvin (2K) to 20K in that the heat capacity of almost all materials strongly decreases. Thus, it is very difficult to find materials that have a sufficiently high heat capacity in the temperature range of 2K to 20K. FIG. 1 shows the structure of a two-stage pulse tube cooler 10 with a first cold stage 11 down to approximately 30K and a second cold stage 12 down to approximately 2K. The first cold stage 11 includes a first pulse tube 13 and a first regenerator 14. The second cold stage 12 includes a second pulse tube 15 and a second regenerator 16 in accordance with the present invention. With the first cold stage 11, temperatures of approximately 30K are reached, and with the second cold stage 12 temperatures of approximately 4K are reached. The first pulse tube 13, the first regenerator 14 and the second pulse tube 15 all terminate in a connection means 17 that separates the environment from the area to be cooled. Working gas 18 is supplied and discharged in a pulsating manner by a pump (not displayed) through working gas line 19. The working gas line 19 ends in the first regenerator 14. In addition, a connection is made to the first pulse tube 13, the second pulse tube 15 and ballast volumes 20 through valves 21.

FIG. 2 (prior art) schematically depicts the structure of a conventional second regenerator 16. The second regenerator 16 in the second cold stage 12 includes a first regenerator portion 22 and a low-temperature regenerator portion 23. FIG. 2 illustrates that the first regenerator portion 22 includes metal sieves 24 that lie on top of each other. The low-temperature regenerator portion 23 includes rare earth compounds, such as erbium nickel (ErNi), holmium copper 2 (HoCu2) and the like. Rare earth compounds are comparatively expensive. Furthermore, those materials are used in the form of pellets 25 whose diameters range from one hundred to several hundred microns (micrometers). A problem exists in fixing the pellets in the oscillating flow of the working gas 18, as each type of movement leads to abrasion of the pellets 25 and thus dust, which drastically reduces the life of the cryo-coolers. Moreover, the pebble bed shown in FIG. 2 requires considerable dead volume, which does not contribute either to heat exchange or to cooling capacity.

Helium is frequently used as a working gas in cryo-coolers. In the temperature range from 2K to 20K, helium has a comparably high heat capacity, which matches the heat capacity of rare earth compounds in this temperature range. Thus, it has been proposed to use helium as the regenerator material. Closed hollow bodies of glass or metal filled with helium have been used as regenerator structures, as disclosed in US2012/0304668 A1, DE10319510 A1, DE102005007627 A1, CN104197591 A, DE19924184 A1 and U.S. Pat. No. 4,359,872 A. These basic concepts have until now not resulted in any finished products. Moreover, pellets filled with helium still result in abrasion, which reduces the useful life of the cryo-cooler. The main problem with using closed hollow bodies filled with helium lies in the costly process of filling the hollow bodies with helium under positive pressure. Due to the positive pressure, the wall thickness of each hollow body must be increased, thereby increasing the heat transfer resistance and reducing the heat transfer.

In the article, "Heat Capacity Characterization of a 4K Regenerator with Non-Rare Earth Material" in Cryocoolers 19, International Cryocooler Conference, Inc., Boulder, Colo., 2016, a structure with an adsorbent material that is suited to absorbing helium is proposed as a regenerator for cryo-coolers. The structure of the regenerator is complex and costly, and there is a danger that parts of the adsorbent material will be carried off by the flow of the working gas. The life of a cryo-cooler with such a regenerator would be drastically reduced if the adsorbent particles were carried off.

It is therefore an object of the present invention to provide a less costly regenerator compared to regenerators that use rare earth compounds. A regenerator is sought that makes use of helium as the heat storage material and nevertheless has a simple structure.

SUMMARY

A regenerator of a cryo-cooler uses helium both as a working gas and as a heat storage material. The regenerator includes a first cell and a second cell whose exterior sides form a flow channel through which the working gas flows. The first cell has a first cavity and a second cavity enclosed by a heat-conductive cell wall. The cavities are connected. The first cavity and the second cavity contain helium that is used to store heat. Both the first cell and the second cell are shaped as disks. The working gas flows both through the flow channel and around the regenerator so as to exchange heat with the helium in the cavities via the heat conducting cell wall. The first cell has a pressure-equalizing opening through the cell wall whose diameter is smaller than the thickness of the cell wall. The diameter of the pressure-equalizing opening is dimensioned to permit the pressure of the helium contained in the first cell to change by a maximum of 20% during any working cycle of the cryo-cooler.

In one embodiment, the first cell includes a first half cell and a second half cell. The first cavity is disposed in the first half cell, and the second cavity is disposed in the second half cell. Each of the first cavity and the second cavity has a triangular cross section. Each of the first half cell and the second half cell has a flat side and an uneven side. The uneven sides of the first half cell and the second half cell are formed complementarily to each other, and the uneven sides contact each other.

A method of making a regenerator of a cryo-cooler that uses helium as a working gas involves producing half cells separately and then connecting them. A first half cell of a first cell is produced using 3D printing. The first half cell has a first cavity. A second half cell of the first cell is also produced using 3D printing. The second half cell has a second cavity. Each of the first cavity and the second cavity has a triangular cross section. The first half cell is attached to the second half cell such that a side of the first half cell contacts a side of the second half cell. The first half cell is produced as a first component and a second component that are fixedly connected to one another subsequently to being formed. The first component has a recess, and the second component covers the recess when the first component and the second component are connected. A pressure-equalizing opening is formed in the wall of the first cell. The diameter of the opening is smaller than the thickness of the cell wall.

The method also involves producing a second cell such that a flow channel is disposed between the first cell and the second cell. The working gas flows through the flow channel.

Helium is frequently used as a working gas in cryo-coolers. In the temperature range from 2K to 20K, helium has a comparably high heat capacity that matches the heat capacity of rare earth compounds in that temperature range. Thus, helium can be used as the regenerator material in closed hollow bodies around which the working gas flows. The main problem of using closed hollow bodies containing helium lies in the costly process of filling the hollow bodies with helium under positive pressure. Due to the positive pressure, the wall thickness of each hollow body must be increased, thereby leading to a worsening of the heat transfer resistance. A novel regenerator uses helium as the heat storage material but nevertheless has a simple structure. In the most basic aspect, the regenerator includes a hollow cell with heat-conducting cell walls. The exterior of the cell walls delimit a flow channel for the helium working gas. The hollow cavity is filled with helium as a heat storage material and is connected to the exterior of the cell by a pressure-equalizing opening. The helium working gas flows around each can-shaped cell, whereby heat is transmitted through the cell walls between the helium working gas outside the cavity and the helium within the cavity. The size of the cells in relation to the size of the flow channel of the working gas is selected such that the desired pressure differences between the high-pressure side and the low-pressure side of the regenerator is achieved with a dead volume that is as small as possible.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
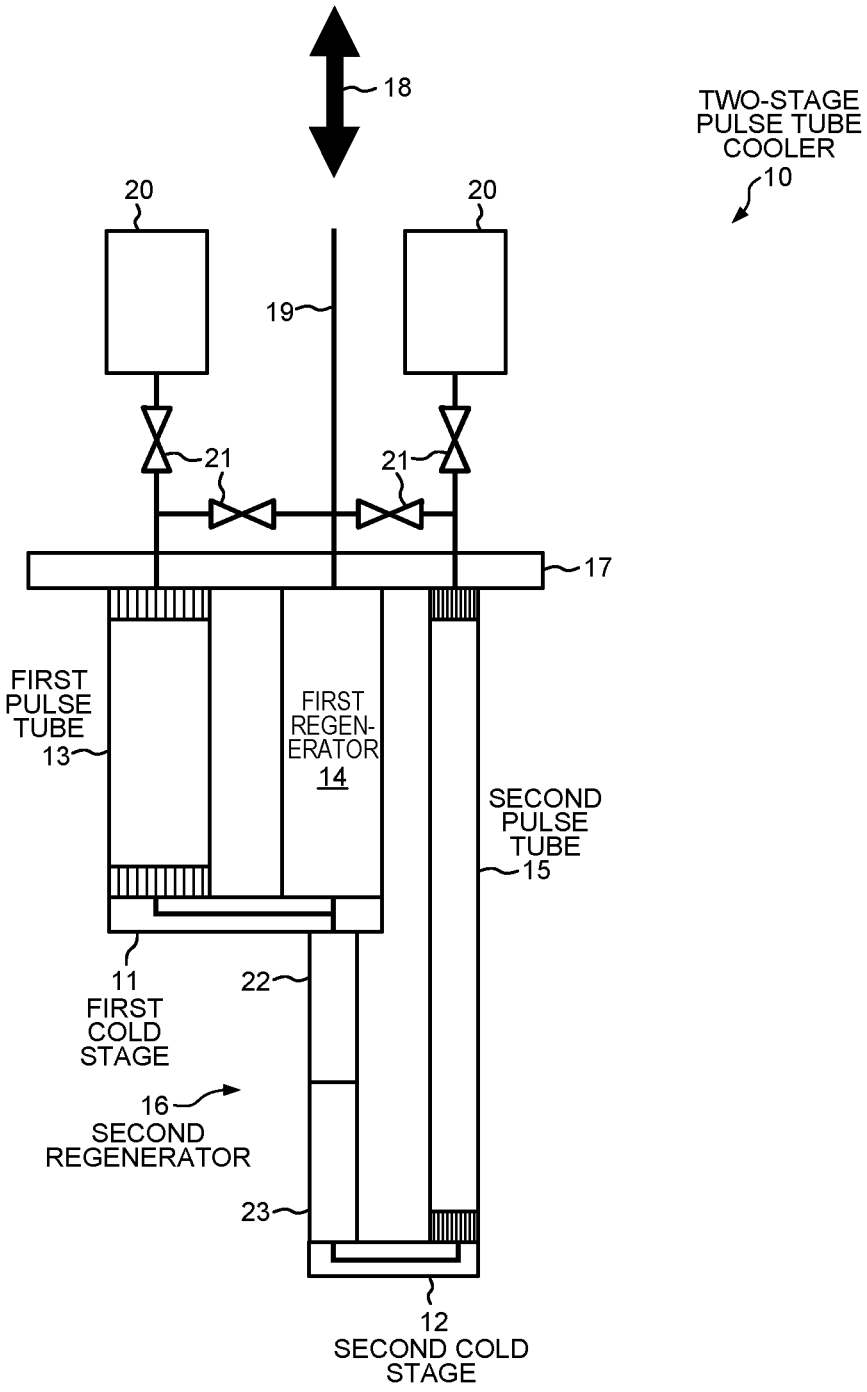
FIG. 1 shows the structure of a cryo-cooler in the form of a pulse tube cooler including two cold stages, the second cold stage including a low-temperature regenerator.
Figure 2:
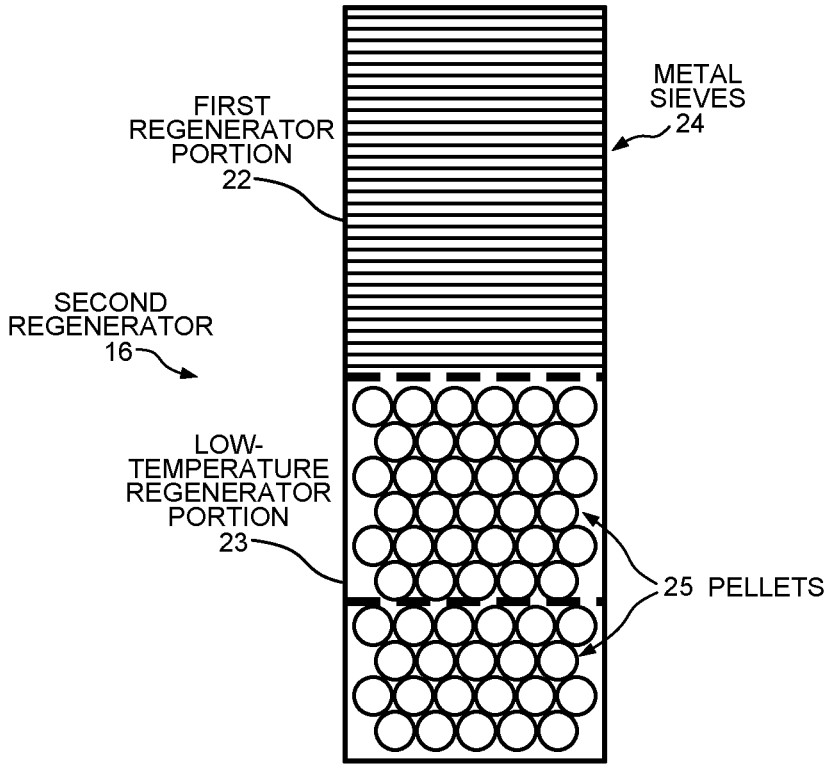
FIG. 2 (PRIOR ART)
FIG. 2 (prior art) shows the schematic structure of a low-temperature regenerator in accordance with the prior art using rare earth material in the form of pellets.
Figure 3:
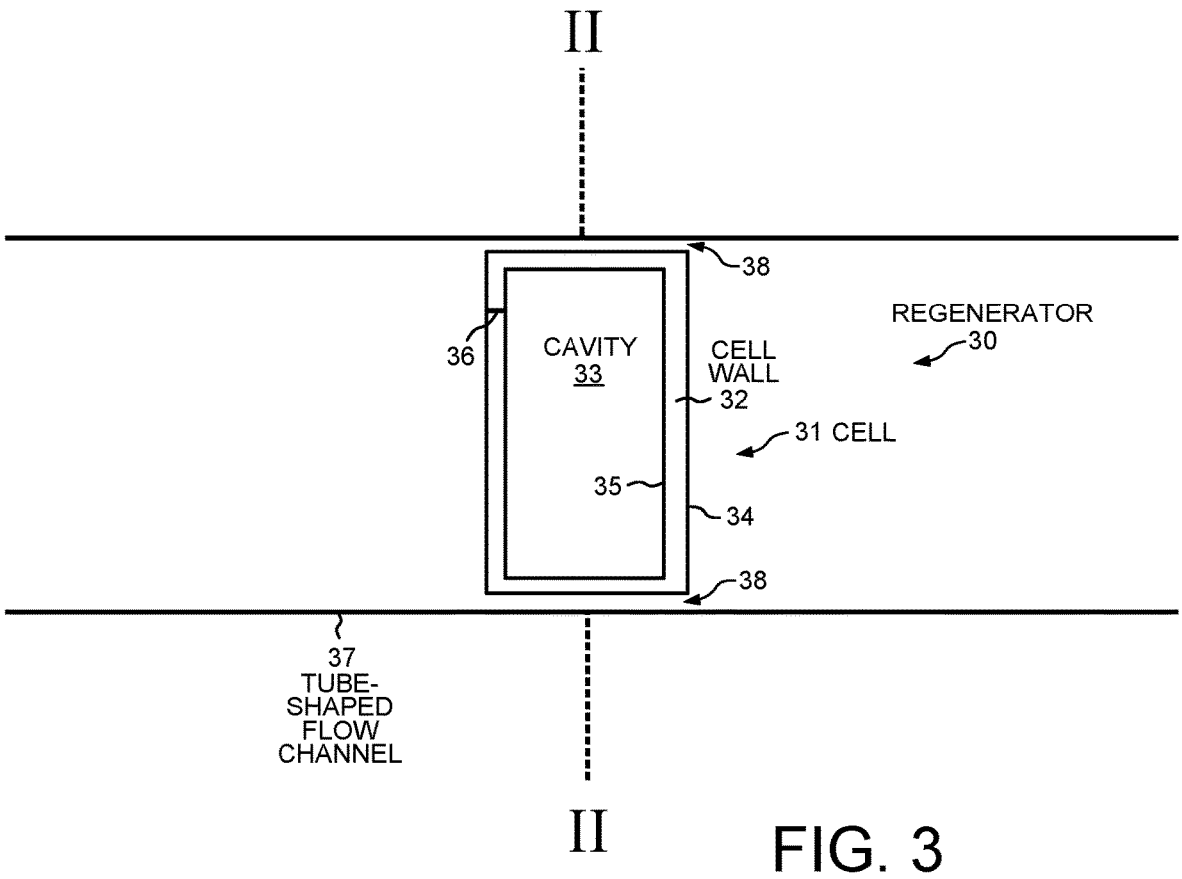
FIG. 3 is a cross-sectional view of a first embodiment of a novel regenerator in a flow channel for working gas.
Figure 4:
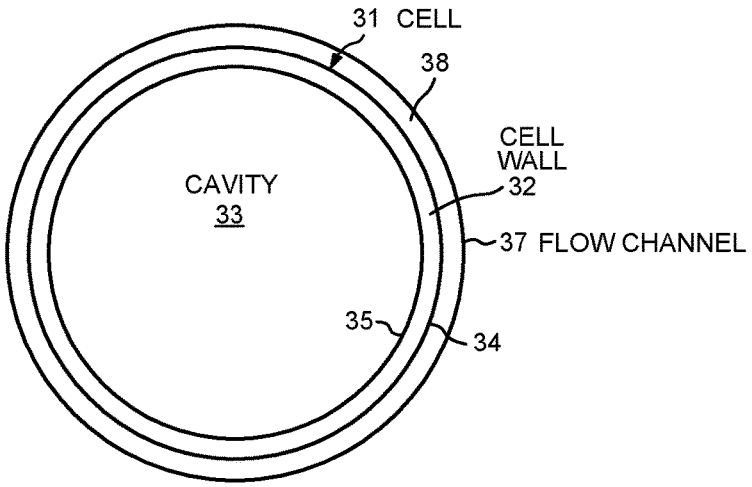
FIG. 4 is a cross-sectional view of the first embodiment along II-II of FIG. 3.

FIGS. 3 and 4 show a first configuration of a regenerator 30 in accordance with the invention in its simplest form. The regenerator 30 comprises a cell 31 including cell walls 32 that surround a cavity 33. The cell walls 32 have an exterior side 34 and an inner side 35. The cell walls 32 are permeated with a pressure-equalizing opening in the form of a capillary or opening 36. The regenerator 30 has an annular cross-section and is arranged in a tube-shaped flow channel 37 for the helium working gas 18. The inside of cavity 33 is filled with helium as a regenerator medium or as a heat storing medium. The regenerator 30 and/or the cell 31 are dimensioned such that an annular gap 38 remains between the tube-shaped flow channel 37 for the working gas and exterior 34 of cell wall 32. Thus, the helium working gas can flow around regenerator 30 and exchange heat with the helium in cavity 33 via heat conducting cell walls 32.

Figure 5A:
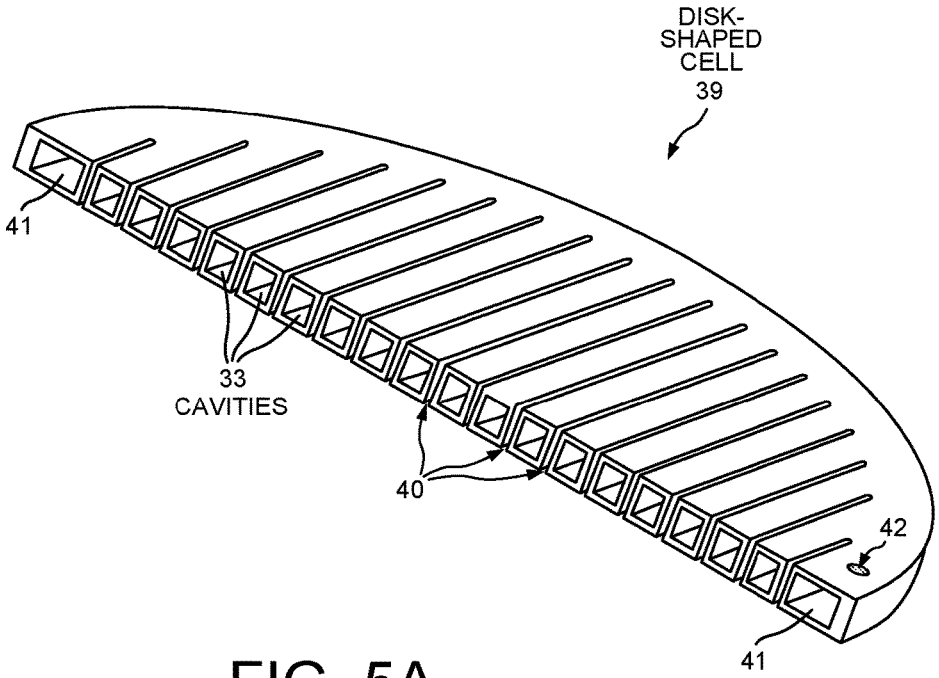
FIGS. 5A and 5B are schematic representations of a second embodiment.
Figure 5B:
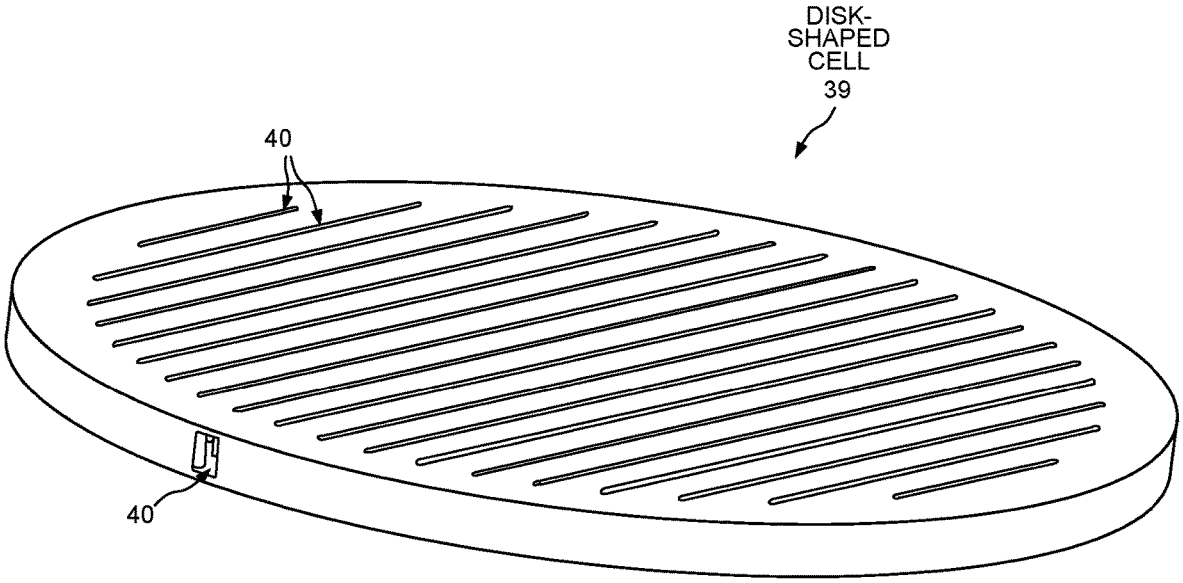

FIGS. 5A and 5B show a second embodiment of the invention with a disk-shaped cell 39. The cell 39 is distinguished from the cell 31 of FIGS. 3 and 4 in that the cell 39 of the second embodiment is permeated by a plurality of straight slits 40 in one plane as flow channels for the working gas 18. The slit-shaped flow channels 40 are parallel to each other, but end before the edge of the cell 39 so that the cell 39 can remain intact. In the rectangular block-shaped areas surrounded by cell walls 32 and between the slit-shaped flow channels 40 there are tube-shaped cavities 33 with rectangular cross-sections. All of the cavities 33 end in a circumferential channel 41 provided on the edge of the disk-shaped cell 39 so that the cavities 33 and the circumferential channel 41 form a single cavity.

In manufacturing disk-shaped cell 39 by way of 3D printing, there initially remain one or two larger openings 42 through which loose material from 3D printing may be blown off after 3D printing. Those openings are subsequently closed, so that merely one or a plurality of pressure-equalizing openings 36 remain in the form of capillaries. A plurality of cells 31 may also be arranged one behind the other in a flow direction of the working gas 18, resulting in a regenerator with increased performance.

Figure 6:
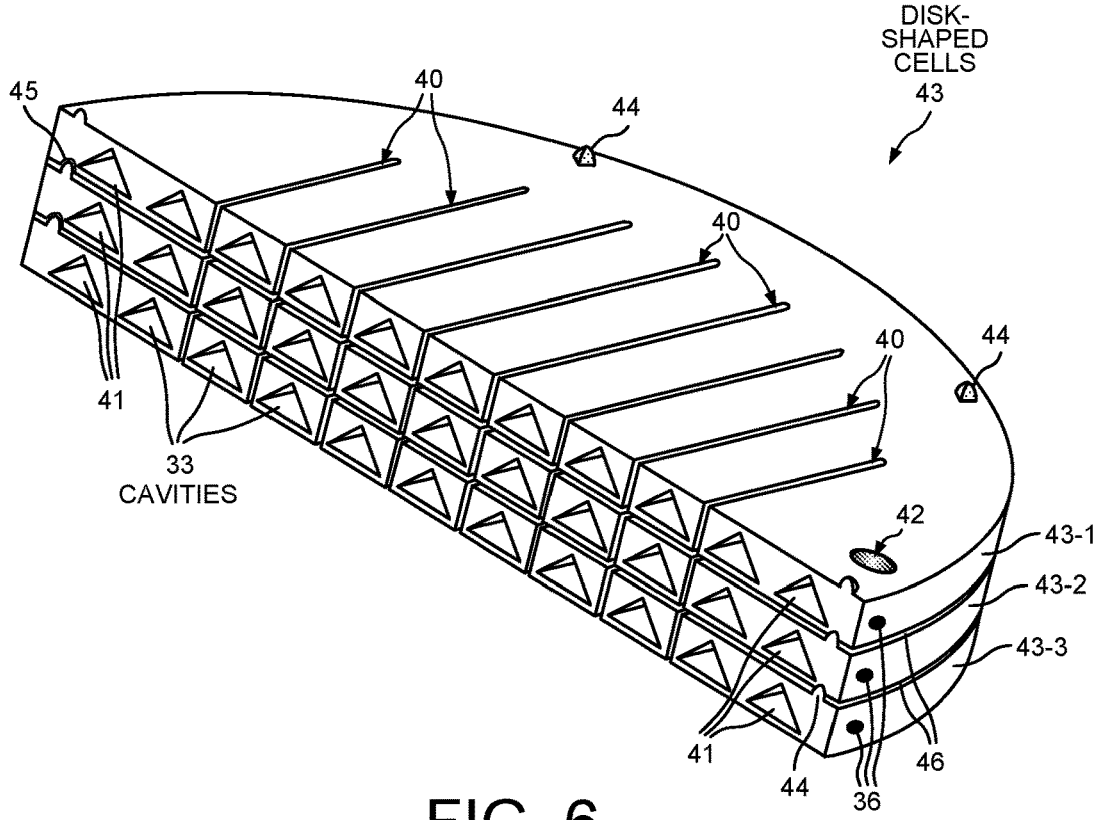
FIG. 6 is a schematic representation of a third embodiment.

FIG. 6 shows a third embodiment of the invention in which a plurality of cells 43-1, 43-2, 43-3 are stacked one above the other. The three disk-shaped cells 43 with circular cross-sections have identical structures. Cells 43 are similar to cell 39 of the second embodiment and are distinguished from the cell 31 of FIGS. 3 and 4 in that the cells 43 are permeated by a plurality of straight slits 40 in one plane as flow channels for the working gas 18. The slit-shaped flow channels 40 are parallel to each other, but end before the edge of each cell 43, so that the cell 43 does not fall apart. In the rectangular block-shaped areas surrounded by cell walls 32 and between the slit-shaped flow channels 40 there are tube-shaped cavities 33 with cross-sections in the shape of an equilateral triangle with a right angle. The apex of the triangle with the right angle points upwards, so that the two sides of the equilateral triangle extend upwards at an angle of 45°. Cavities 33 with a triangular cross-sections may be easily manufactured by way of 3D printing. In manufacturing disk-shaped cells 43 by way of 3D printing, there initially remain one or two larger openings 42 through which loose material from 3D printing may be blown off after 3D printing. These openings 42 are subsequently closed, so that merely one or a plurality of pressure-equalizing openings 36 remain in the form of capillaries.

The cavities 33 are interconnected at the edge of each disk-shaped cell 43. A pressure-equalizing opening 36 connects cavities 33 with the area outside of the cells 43. On their upper side, cells 43 have a plurality of alignment pins 44, and on the opposite side corresponding aligning recesses 45 are located. These alignment elements 44, 45 are used to align the slit-shaped flow channels 40 of upper cells 43 with those of lower cells 43 on which they lie, thus resulting in continuous flow channels that pass through the regenerator 30. A thermally insulating layer 46 that is permeated by alignment pins 44 is disposed between each of the individual cells 43 so that the alignment pins mesh with the alignment openings 45 arranged above.

Figure 7:
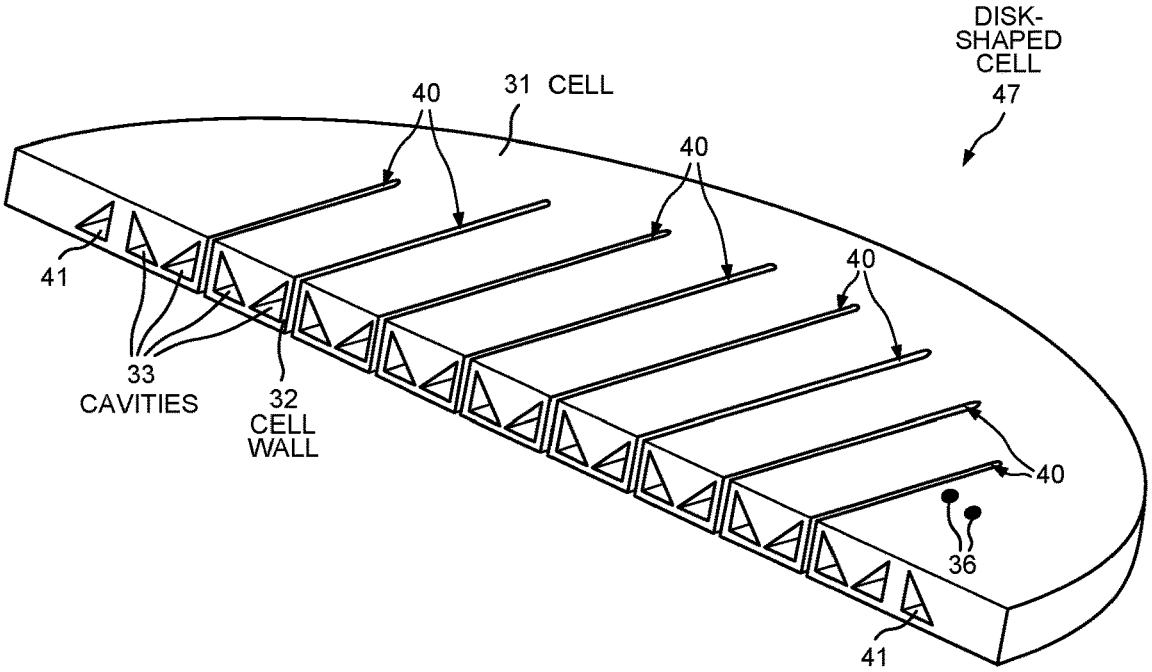
FIG. 7 is a schematic representation of a fourth embodiment.

FIG. 7 schematically shows a fourth embodiment of the regenerator 30 in the form of a disk-shaped cell 47, which is distinguished from cells 43 of FIG. 6 in that each tube-shaped cavity 33 includes two portions as opposed to one. The cross-section of each portion of the tube-shaped cavity 33 has the shape of an equilateral triangle with a right angle. The right angle is disposed at the inner side of the cell wall 32 that delimits each slit-shaped flow channel 40. This results in a cell wall 32 with a constant wall strength between flow channels 40 and cavities 33. This leads to improved heat transfer between the working gas 18 in the flow channel 40 and the helium in the cavities 33. The pressure-equalizing openings 36 connect cavities 33 with the area outside of cell 47.

Figure 8:
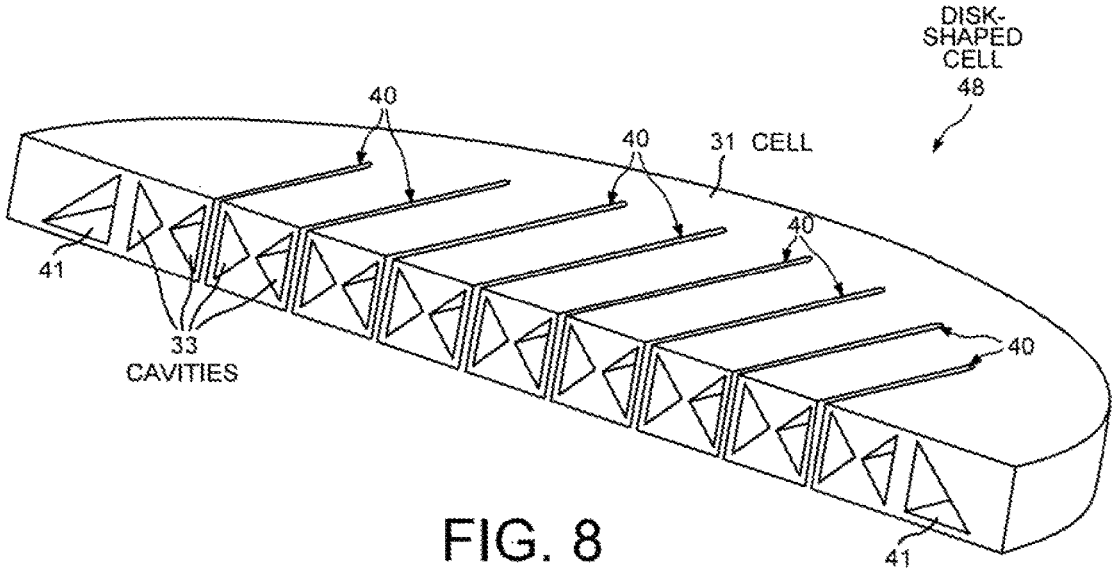
FIG. 8 is a schematic representation of a fifth embodiment.

FIG. 8 shows a fifth embodiment of regenerator 30, which is distinguished from the embodiment of FIG. 6 merely in that the tube-shaped cavities 33 with triangular cross-sections are arranged with the bases of the right triangles adjacent the flow channels 40. Heat transfer between the gas in the flow channels 40 and the gas in the cavities 33 is improved by making the walls 32 between the channels and the cavities consistently thin.

Figure 9:
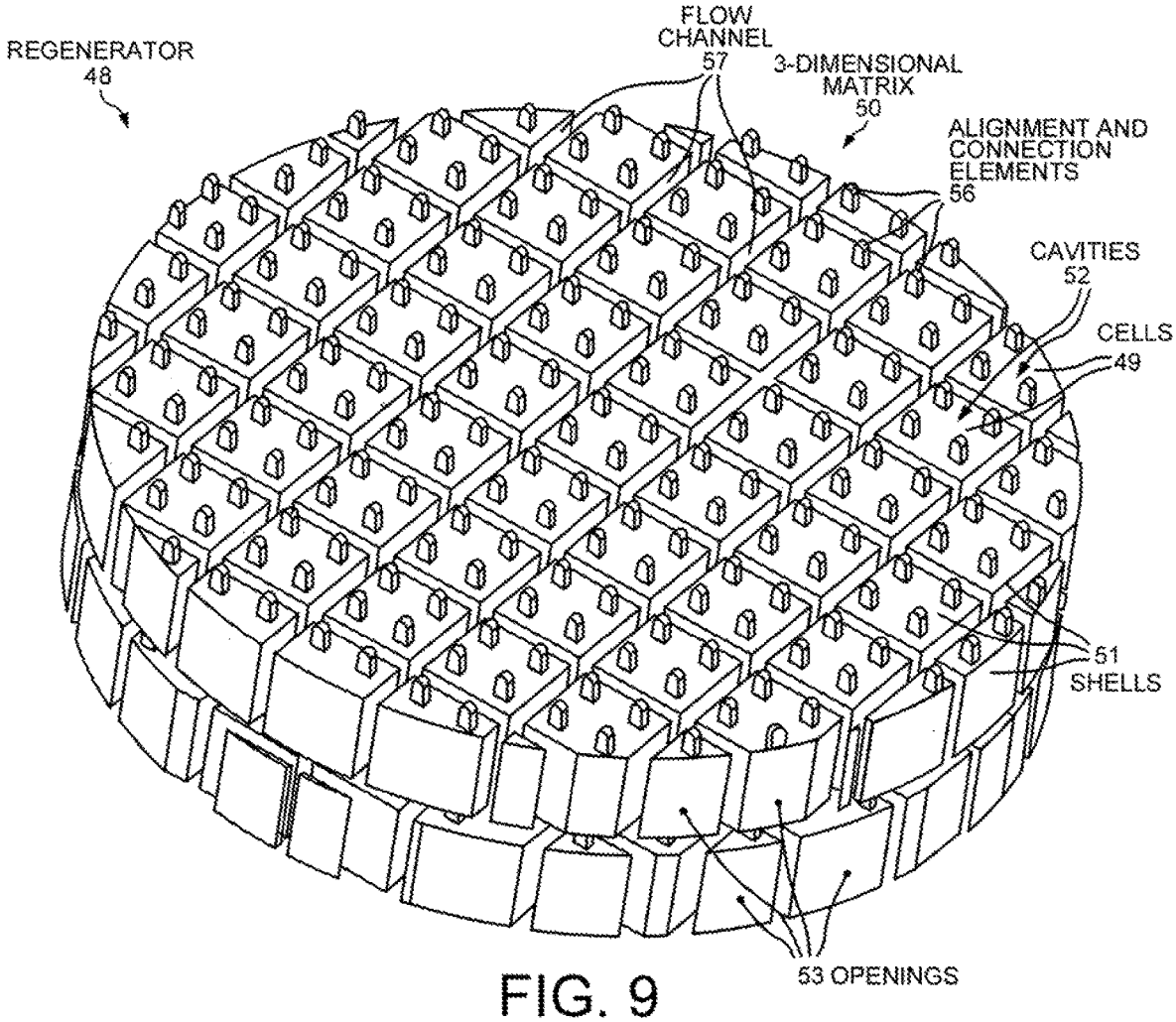
FIG. 9 is a sixth embodiment in the form of a three-dimensional matrix arrangement with two layers of cells with an annular outer diameter.
Figure 10:
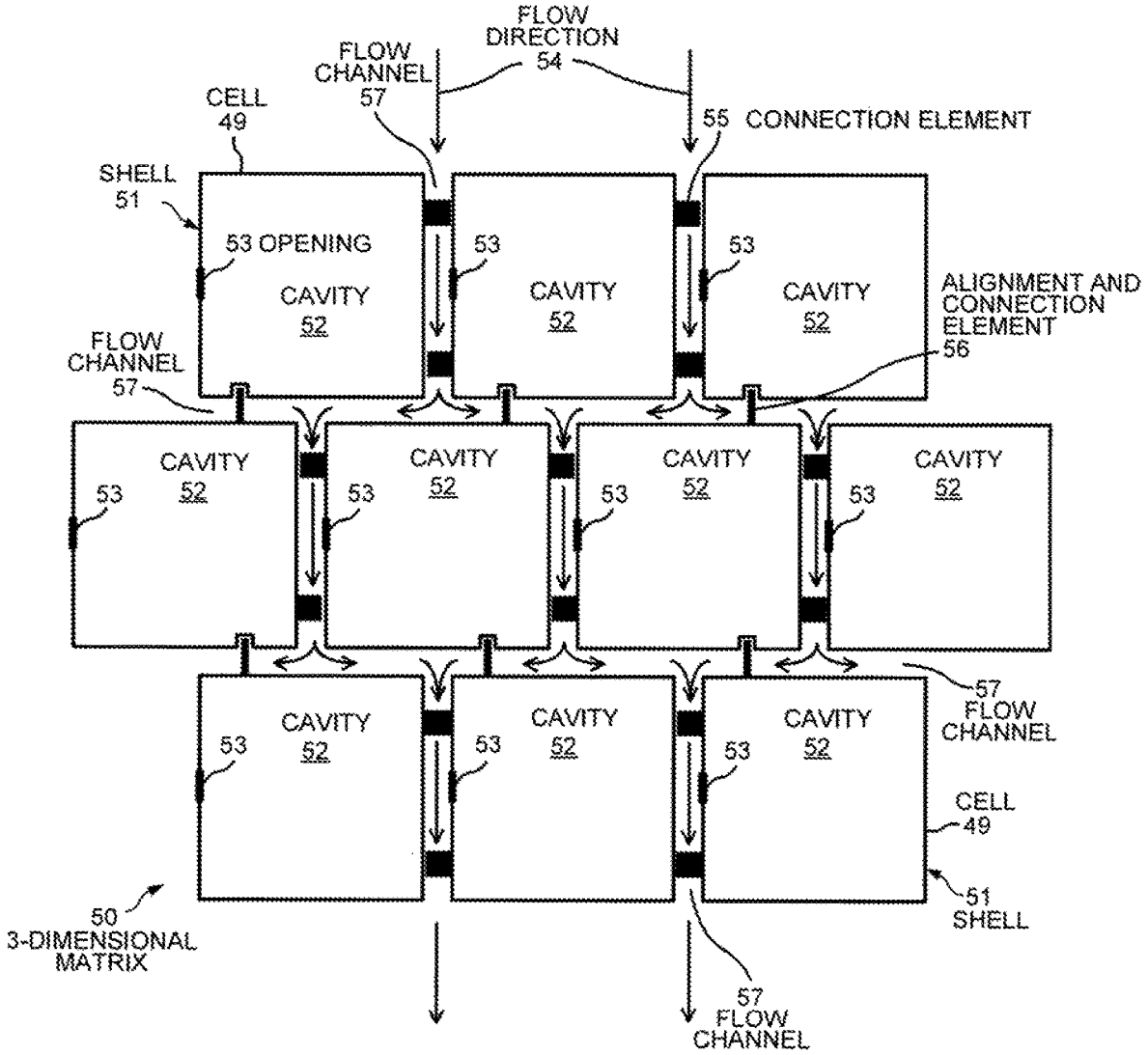
FIG. 10 is a detailed representation of the matrix arrangement of FIG. 9 with three layers of cells, viewed perpendicularly to the flow direction of the working gas.

FIGS. 9 and 10 schematically show the structure of a sixth embodiment of the invention. FIG. 9 shows a regenerator 48 with a large number of cells 49 that are arranged in the form of a three-dimensional matrix 50 with two layers of cells 49. The cells 49 are shaped as cubes and are essentially identical in their structure. However, as the regenerator 48 fills the circular cross-section of a tube, the cells 49 inevitably have a deviating shape at the sides. Each cell 49 has a heat conducting shell 51 that encloses a cuboid cavity 52. Each cell 49 also has a pressure-equalizing opening 53 in the form of a capillary. FIG. 10 shows that the individual cells 49 are staggered one behind the other in the flow direction 54 of the working gas 18. The cells 49 next to each other are connected to each other by thermally conducting connection elements 55. The cells 49 that are behind one another in the flow direction 54 are connected to each other by thermally insulating or poorly conducting alignment and connection elements 56. The alignment elements 56 connect the cells 49 of the various layers so that the flow channels 57 of the layers exhibit the proper staggered alignment. The alignment elements 56 include alignment pins on the cells of the downstream layer that fit into alignment recesses in the cells of the upstream layer, as illustrated in FIG. 10. The connection elements 55, 56 build a mechanically fixed matrix arrangement 50 of cells 49 that forms a flow channel 57. FIG. 9 shows only two layers of cells 49, whereas FIG. 10 shows three layers of cells 49. Other embodiments can have three or more layers of cells. The gas volume of the individual cavities 52 is approximately one cubic millimeter (1 $mm^3$), and the wall thickness of each shell 51 is approximately 0.2 mm. The distance between the individual cells 49 is approximately 0.2 mm. The total space occupied by each cell 49 is approximately eight $mm^3$.

The regenerator 48 in accordance with the invention is preferably used as a low-temperature regenerator portion 23 in the lowest cold stage of a cryo-cooler.

Figure 11:
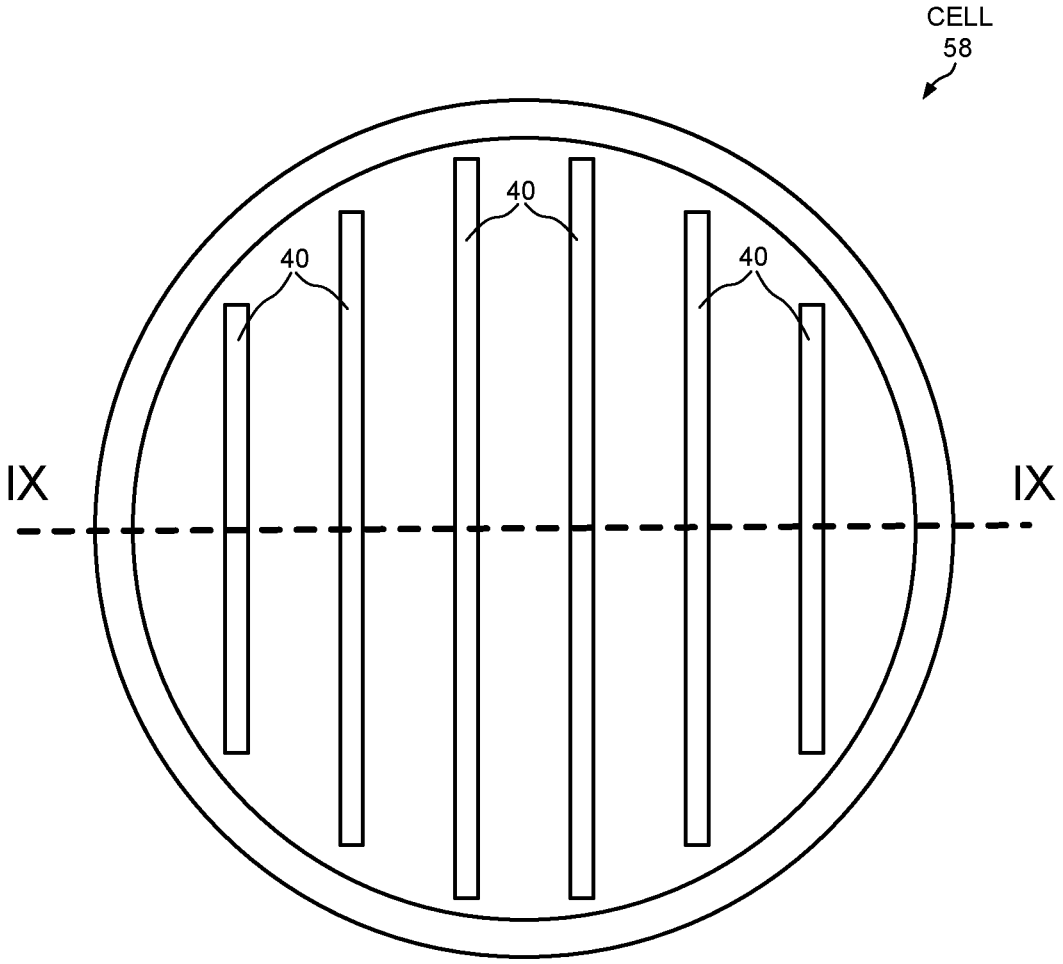
FIGS. 11 and 12 are schematic representations for the production of a regenerator made of a shell structure and a cover in accordance with a seventh embodiment.
Figure 12:
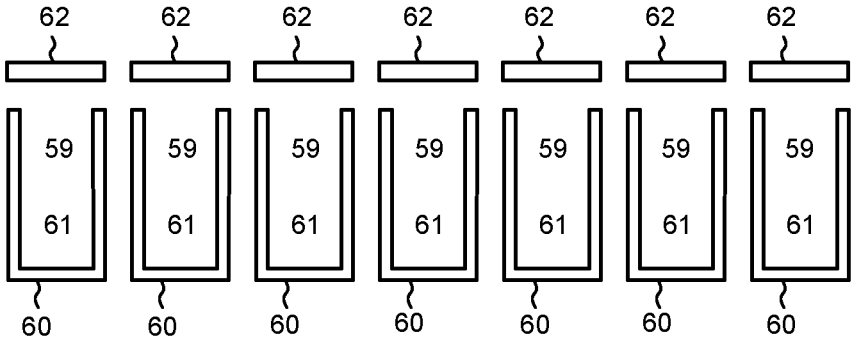

FIGS. 11 and 12 show a seventh embodiment of the invention, in which the cell 58 is provided with slit-shaped flow channels 40 corresponding to the embodiments of FIGS. 5 to 9. The distinction to the embodiments of FIGS. 5 to 9 lies in the shape of tube-shaped cavities 59. As in the second embodiment of FIGS. 5A and 5B, the cavities 59 have a rectangular cross-section. In contrast to the second embodiment, however, the manufacturing is performed in two steps with at least two components. To begin with, a first component 60 with an open cavity or pot-shaped recess 61 is produced, for example, by 3D printing. In a second step, loose 3D printing material is removed from the pot-shaped recesses 61. In a third step, each recess 61 is then covered by a second component 62, which resembles a cover. The first and second components 60, 62 are fixedly connected to each other, for example, through welding or adhesive bonding.

Figure 13:
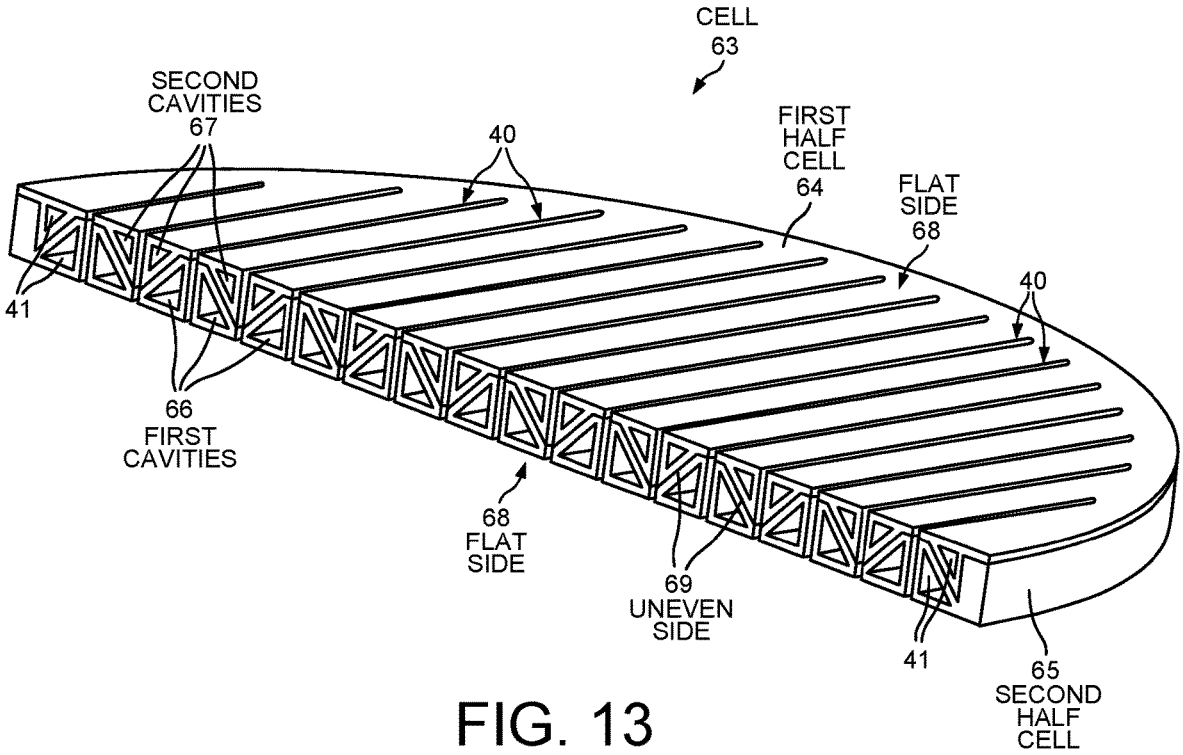
FIG. 13 is an eighth embodiment of the invention that includes two structures produced by 3D printing.

FIG. 13 shows an eighth embodiment in the form of a disk-shaped cell 63 that is composed of a first half cell 64 and a second half cell 65. Thus, the resulting cell 63 includes, by analogy to the embodiments of FIGS. 7-8, composite structures between the slit-shaped flow channels 40 that have square cross-sections. The first half cell 64 has a plurality of first cavities 66, and the second half cell 65 has a plurality of second cavities 67. Both the first cavities 66 and the second cavities 67 have cross-sections of equilateral triangles. The two half cells 64, 65 may be produced by 3D printing. The two half cells both have a flat side 68 and an uneven side 69. The two uneven sides 69 are complementary in shape such that when the two half cells 64, 65 are assembled, complementary uneven sides 69 of the two half cells lie on top of each other. Compared to the embodiments of FIGS. 6-8, the proportion of the cavity volume to the total volume of the regenerator is increased in the regenerators with cells that each have two half cells 64, 65. Such a regenerator thereby has a higher performance.

Similarly to the second embodiment of FIGS. 5A-B and the embodiments of FIGS. 6-11, cell 63 of the eighth embodiment also has a circumferential channel 41.

Although pressure-equalizing openings 36 are not shown in all of the cells 31, 39, 43, 47, 48, 58 and 63, these openings exist. Because the cavities 33, 52, 59, 66, 67 are interconnected, the pressure-equalizing openings 36 may be located at any place on the cells.

Figure 14A:
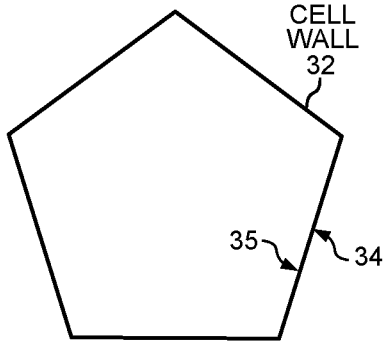
FIGS. 14A, 14B and 14C show examples for cross-sections of the cavities that contain the heat-storing helium, which easily may be manufactured through 3D printing.
Figure 14B:
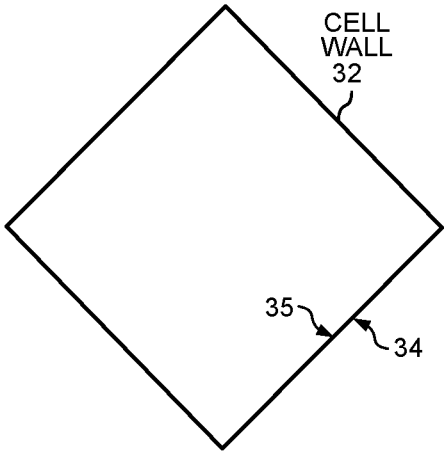
Figure 14C:
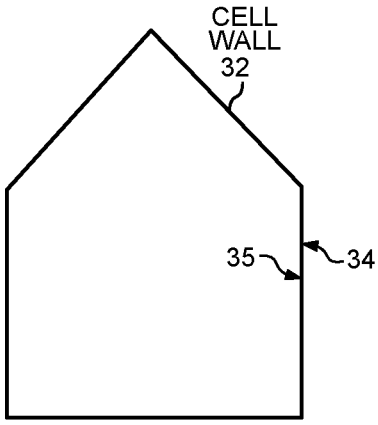

FIGS. 14A, 14B and 14C illustrate further possible shapes of cross-sections of cavities 33 in the disk-shaped regenerators in accordance with FIGS. 5-8 and 13, which may be produced easily using 3D printing.

In the simplest case, the regenerator 30 includes a hollow cell 31 with heat-conducting cell walls 32. The exterior of the cell walls at least partly delimits a flow channel 37 for the helium working gas 18. A hollow cavity 33 is filled with helium as a heat storage material and is connected to the exterior of the cell 31 via a pressure-equalizing opening 36. The helium working gas 18 flows around the can-shaped cell, whereby heat is transmitted between the helium working gas outside of the cavity 33 and the helium within the cavity via the cell walls 32. The size of the cells 31 in relation to the size of the flow channel 37 of the working gas 18 is selected such that the desired pressure difference between the high-pressure side and the low-pressure side of the regenerator 30 is achieved using a dead volume that is as small as possible. The walls 32 of the cell 31 are very thin, so that the desired heat exchange is facilitated.

The ratio of the volume of the cavity/cavities 33 to an opening surface or escape resistance of the pressure-equalizing opening 36 is selected such that the pressure in the cavity or cavities 33 in the working frequency range of the cooling operation (approx. 1 to 60 Hz) is hardly changed or changes only a little. The mode of operation is comparable to that of a capacitor at high frequencies where there is virtually no effect from a voltage change if a capacitance is high enough and the voltage change is low. In a typical application, the pressure in the cell 31 fluctuates around the average pressure of the cooling system, typically approximately 16 bar. Stable pressure therefore is important, as otherwise the volume of the cavity/cavities 33 would largely contribute to "dead volume" in case the pressure fluctuates with each period, e.g., between 8 and 24 bar without contributing to cooling.

The opening surface or the escape resistance of the pressure-equalizing opening 36 is selected such that prior operating the regenerator 30 and during the startup phase, helium penetrates into the cavity/cavities 33 on account of the existing pressure ratios. Due to the high escape resistance of the pressure-equalizing opening 36, the "capacitor effect" described above occurs during the pressure fluctuations in the range of the working frequency of the regenerator 30 of a cryo-cooler. In the startup phase, the temperature of the helium working gas 18 and also of the helium in the regenerator cavities 33 decreases. Consequently, the volume of the helium decreases and through the pressure-equalizing openings 36, helium continues to flow into the regenerator cavities 33. This means that during the startup phase helium has to be refilled until the working temperatures and working pressures have been set. Without pressure-equalizing openings, the cavities 33 in the cells 31 would have to be filled with helium beforehand, which would result in considerably thicker cell walls on account of pressures of about 16 bar in the working range of the cryo-cooler. In case the cavities 33 are filled with helium at ambient temperatures, still higher pressures must be selected for filling due to the low density of helium at ambient temperatures. This leads to thicker cell walls with considerably higher thermal resistance. On account of the thicker cell walls, the thermal resistance of the cell walls would become so great that, in the working frequency range of cryo-coolers, there hardly would be a heat exchange between the helium working gas 18 and the helium in the inside of the cavity/cavities 33. This probably also is the reason for the fact that no cryo-cooler is on the market that makes use of a regenerator with helium in closed cavities.

In another embodiment, the cell 31 is permeated with flow channels 40 delimited by cell walls 32. This results in an enlarged heat exchange surface and an improved heat transfer between the helium in the cavities and the working gas 18 outside. The flow channels 40 are preferably formed as slits. The slit-shaped flow channels 40 for working gas 18 preferably run straight and in parallel with each other, so as to minimize flow resistance on the one hand and, on the other hand, to uniformly configure the tube-shaped cavities between the flow channels 40. In a simple manner, the straightness and parallelism of the flow channels 40 result in the space between two flow channels being equal.

The round outer shape of the regenerators 30 permits them to be integrated in a simple way into the typically round cross-sections of the cryo-coolers. A single cell 31, possibly including a plurality of tube-shaped structures, may have the shape of a disk. Alternatively, a plurality of cells 31 may be combined to form a disk.

By arranging the cells 49 one behind the other, the heat storage capacity of the regenerator increases. The thermal insulation between the cells 49 arranged one behind the other in a flow direction 54 of the working gas 18 prevents heat from being exchanged between the cavities 52 in the flow direction of the working gas. Such a heat exchange in a flow direction 54 of the working gas 18 would signify a short circuit of the regenerator because heat exchange in the flow direction of the working gas does not contribute to the function of the regenerator. The thickness of the thermally insulating layer preferably is between 0.1 mm and 0.5 mm.

By using alignment elements or connection elements 56, the correct alignment of the flow channels 40 of cells 49 on top of one another is simplified. The alignment elements 56 are, for example, alignment pins that have a conical or pyramid-shaped tip.

The pressure-equalizing opening 53 preferably has the shape of a capillary, in which the cross-sectional area of the opening is very small compared to the surface of the hollow body and whose opening diameter is very small compared to the thickness of the cell wall 32. A pressure-equalizing opening 53 may also be formed through leaks that occur during the production of the cells 49.

The size and thus permeability of the pressure-equalizing openings 53 are selected such that during a working cycle of the regenerator, the pressure change in a cell is 20% at maximum and preferably 10% at maximum. It is an optimizing process. The larger the capillary 53, the higher is the undesired material exchange, the higher are pressure fluctuations in the cavity 52 of each cell 49, and the quicker is the penetration of helium into the cavities 52 upon operation of the regenerator. The smaller the capillary, the less compression work is to be done, but the longer it takes for helium to penetrate into the cavities 52 upon operation of the regenerator. The diameter of the pressure-equalizing opening is set to permit the pressure of the helium contained in each cell 49 to change by a maximum of 20% during any working cycle of the regenerator In order to improve the heat storage and the heat exchange between the helium working gas 18 and the helium present in the hollow body, the surfaces of the hollow bodies are provided with turbulence structure.

The cross-sectional shapes of the tube-shaped cavities 33 make it possible to produce a regenerator 30 using 3D printing. A rectangular block shape or rectangular shape of the cross-sections of the cavities 33 is ideal for heat exchange. Cells 43 with tube-shaped cavities 33 with at least one slanting cell wall or with triangular cross-section may be produced easily by 3D printing. By way of 3D printing, structures with vertical or slanting cell walls (slants of 45° or more) may be produced easily. Producing the slanted cell walls 32 is easiest if the triangular cross-section of the cavities 33 has a right angle. The cross-section of the tube-shaped cavities 33 can also be diamond-shaped, pentagonal, or in the shape of a house, as shown in FIG. 14.

For optimal heat exchange between helium in the tube-shaped cavities 33 and the helium working gas 18 outside of the cavities, flow channels 40 are arranged between the tube-shaped cavities.

By producing each cell 63 in two parts, in which a disk-shaped regenerator includes disk-shaped cells and each cell 63 includes two half cells 64-65, both half cells can be manufactured using 3D printing. At the same time, the proportion of the volume of the cavities, and thus of the helium in the cavities, to the total volume of the regenerator is increased compared to regenerators that merely include single piece cells. In this way, the heat storage capacity of the regenerator is increased, and the regenerator can be designed more compactly with the same heat capacity.

In 3D printing methods, rectangular block-shaped or ellipsoid cavities can be manufactured as a whole, or from two components in two steps. A first component 60 with "open cavities" or pot-shaped recesses 61 is produced in a first step. Those recesses 61 are then covered in a second step by second components 62. The first and second components 60, 62 are fixedly and durably connected to each other, for example, by bonding with an adhesive or welding.

The regenerators of the present invention are suited in particular for use with Stirling coolers, Gifford-McMahon coolers, or pulse tube coolers.

The hollow bodies can be made of metal and can be very thin as opposed to the prior art on account of the pressure-equalizing openings 53, whereby the heat transfer resistance between the helium inside the cavities 52 and the helium working gas 18 outside of the cavities is reduced. The cell walls 51 of the cavities preferably have a constant thickness at least along the flow channels within a range of 0.1 mm to 0.5 mm. Uniform heat transfer between the helium working gas 18 in the flow channels 57 and helium in the cavities 52 is achieved by an even wall thickness of the cell walls 51. The entire regenerator preferably has a dimension of 5 mm to 100 mm in the flow direction 54 of the working gas 18.

REFERENCE NUMERALS

10 two-stage pulse tube cooler
11 first cold stage
12 second cold stage
13 first pulse tube
14 first regenerator
15 second pulse tube
16 second regenerator
17 connection means
18 working gas
19 working gas lines
20 ballast volume
21 valves
22 first regenerator portion of 16
23 low-temperature regenerator portion of 16
24 metal sieves in 16
25 pellets of rare earth compounds
30 regenerator
31 cell
32 cell wall
33 cavity
34 exterior side of cell wall 32
35 inner side of cell wall 32
36 pressure-equalizing opening
37 flow channel for working gas
38 annular gap between 31 and 37
39 disk-shaped cell of second embodiment
40 slit-shaped flow channels for working gas
41 circumferential communication channel
42 blow-off holes
43 disk-shaped cell of third embodiment
44 alignment pin
45 aligning recesses
46 thermally insulating layer
47 disk-shaped cell of fourth embodiment
48 regenerator
49 cells
50 matrix arrangement
51 shell or cell walls
52 cavity
53 pressure-equalizing opening
54 flow direction of the working gas
55 thermally conducting connection elements
56 thermally insulating connection elements
57 flow channel
58 cell of seventh embodiment
59 tube-shaped cavities
60 first component with a pot-shaped recesses
61 pot-shaped recesses
62 second component, a cover
63 cell of eighth embodiment
64 first half cell
65 second half cell
66 first cavities
67 second cavities
68 flat side of 64-65
69 uneven side of 64-65

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A regenerator of a cryo-cooler that uses helium both as a working gas and to store heat, comprising:

a cell wall of a first cell;

a first cavity of the first cell; and a second cavity of the first cell, wherein the cell wall has an exterior side and an inner side, wherein the cell wall is heat conductive, wherein the first cavity and the second cavity are connected to each other such that helium flows between the first cavity and the second cavity during operation of the regenerator, wherein the exterior side of the cell wall forms a flow channel through which the working gas flows during operation of the regenerator, wherein helium contained in the first cavity and the second cavity stores heat during operation of the regenerator, wherein the first cell has a pressure-equalizing opening that connects the inner side and the exterior side of the cell wall, and wherein during operation of the regenerator helium flows through the pressure-equalizing opening so as to equalize a pressure of the helium in the first cavity, a pressure of the helium in the second cavity, and a pressure of the helium used as a working gas on the exterior side of the cell wall.

2. The regenerator of claim 1, wherein the flow channel passes through the first cell.

3. The regenerator of claim 1, wherein the first cell is shaped as a disk.

4. The regenerator of claim 1, further comprising:

a second cell, wherein the working gas flows through the regenerator in a flow direction, and wherein the second cell is disposed behind the first cell in the flow direction.

5. The regenerator of claim 4, wherein the first cell is separated from the second cell by a portion of the flow channel that passes between the first cell and the second cell.

6. The regenerator of claim 4, further comprising:

an alignment element that connects the second cell to the first cell such that the flow channel of the first cell is properly aligned with the second cell.

7. The regenerator of claim 6, wherein the alignment element is an alignment pin on the second cell that fits into an alignment recess on the first cell.

8. The regenerator of claim 6, wherein the alignment element is an alignment pin on the second cell that permeates an alignment opening on the first cell.

9. The regenerator of claim 1, wherein the cell wall has a thickness, and wherein the pressure-equalizing opening is shaped as a capillary whose diameter is less than the thickness of the cell wall.

10. The regenerator of claim 1, wherein the pressure-equalizing opening is a manufacturing remnant of 3D printing adapted to allow removal of loose material from the 3D printing.

11. The regenerator of claim 1, wherein the pressure-equalizing opening has a diameter whose magnitude is adapted to permit the helium contained in the first cell to have a pressure that changes by a maximum of 20% during any working cycle of the regenerator.

12. The regenerator of claim 1, wherein each of the first cavity and the second cavity is shaped as a tube with a cross section whose shape is taken from the group consisting of: a triangle, a rectangle and a pentagon.

13. The regenerator of claim 1, wherein each of the first cavity and the second cavity is shaped as a tube, and wherein the flow channel passes between the first cavity and the second cavity.

14. The regenerator of claim 1, wherein the first cell includes a first half cell and a second half cell, wherein the first cavity is disposed in the first half cell and the second cavity is disposed in the second half cell, and wherein each of the first cavity and the second cavity has a triangular cross section.

15. The regenerator of claim 14, wherein each of the first half cell and the second half cell has a flat side and an uneven side, wherein the uneven sides of the first half cell and the second half cell are formed complementarily to each other, and wherein the uneven sides contact each other.

16. The regenerator of claim 1, wherein the cryo-cooler is taken from the group consisting of: a Gifford-McMahon cooler, a pulse tube cooler, and a Stirling cooler.

17. The regenerator of claim 16, wherein the pressure-equalizing opening has a diameter whose magnitude is adapted to permit the helium contained in the first cell to have a pressure that changes by a maximum of 20% during any working cycle of the regenerator.

18. The regenerator of claim 1, wherein the pressure-equalizing opening has a diameter that is smaller than 0.1 mm.

19. A regenerator of a cryo-cooler that uses helium as a working gas, comprising:

a first cell that includes a cell wall, a first half cell and a second half cell;

a first cavity disposed in the first half cell; and a second cavity disposed in the second half cell, wherein the cell wall has an exterior side and an inner side, wherein the cell wall is heat conductive, wherein the first cavity and the second cavity are connected to each other, wherein the exterior side of the cell wall forms a flow channel through which the working gas flows, wherein the first cell has a pressure-equalizing opening between the inner side and the exterior side of the cell wall, wherein the first cavity and the second cavity contain helium that is used to store heat, and wherein each of the first cavity and the second cavity has a triangular cross section.

20. The regenerator of claim 19, wherein each of the first half cell and the second half cell has a flat side and an uneven side, wherein the uneven sides of the first half cell and the second half cell are formed complementarily to each other, and wherein the uneven sides contact each other.

* * * * *